United States Patent [19]

Linden

[11] Patent Number: 4,607,479

[45] Date of Patent: Aug. 26, 1986

[54] APPARATUS FOR PACKAGING GIVEN QUANTITIES OF SNUFF

[75] Inventor: Günther Linden, Huddinge, Sweden

[73] Assignee: Svenska Tobaks AB, Stockhoom, Sweden

[21] Appl. No.: 674,507

[22] Filed: Nov. 23, 1984

[30] Foreign Application Priority Data

Dec. 14, 1983 [SE] Sweden ..... 8306913

[51] Int. Cl.[4] ..... B65B 9/08; B65B 9/20

[52] U.S. Cl. ..... 53/530; 53/550; 53/562

[58] Field of Search ..... 53/529, 530, 550, 551, 53/562, 568, 575; 141/67, 256; 222/368, 371, 636

[56] References Cited

U.S. PATENT DOCUMENTS

| | | | |
|---|---|---|---|
| 2,567,052 | 9/1951 | Carruthers | 53/529 |
| 2,613,488 | 10/1952 | Attride | 53/575 |
| 2,654,195 | 10/1953 | Irmscher | 53/568 |
| 2,962,843 | 12/1960 | Hoelzer et al. | 53/551 |
| 3,279,658 | 10/1966 | Dinges | 222/371 |
| 4,165,822 | 8/1979 | Jaudt | 222/636 |
| 4,501,709 | 2/1985 | Monsees | 53/551 |

*Primary Examiner*—Horace M. Culver

*Attorney, Agent, or Firm*—Kinzer, Plyer, Dorn & McEachran

[57] ABSTRACT

An apparatus for packaging snuff ready for use in the form of portions enclosed, for example, in a paper sachet (3,9) from a snuff store. The apparatus is characterizing in that the portioning means (3,9) is arranged to compress the snuff portion in a portion pocket (9), wherewith each portion pocket comprises a through-passing opening in a portion conveyor (4). The compressed snuff portions are blown by pneumatic means (11,14) to an intended position in a packaging band (16).

6 Claims, 7 Drawing Figures

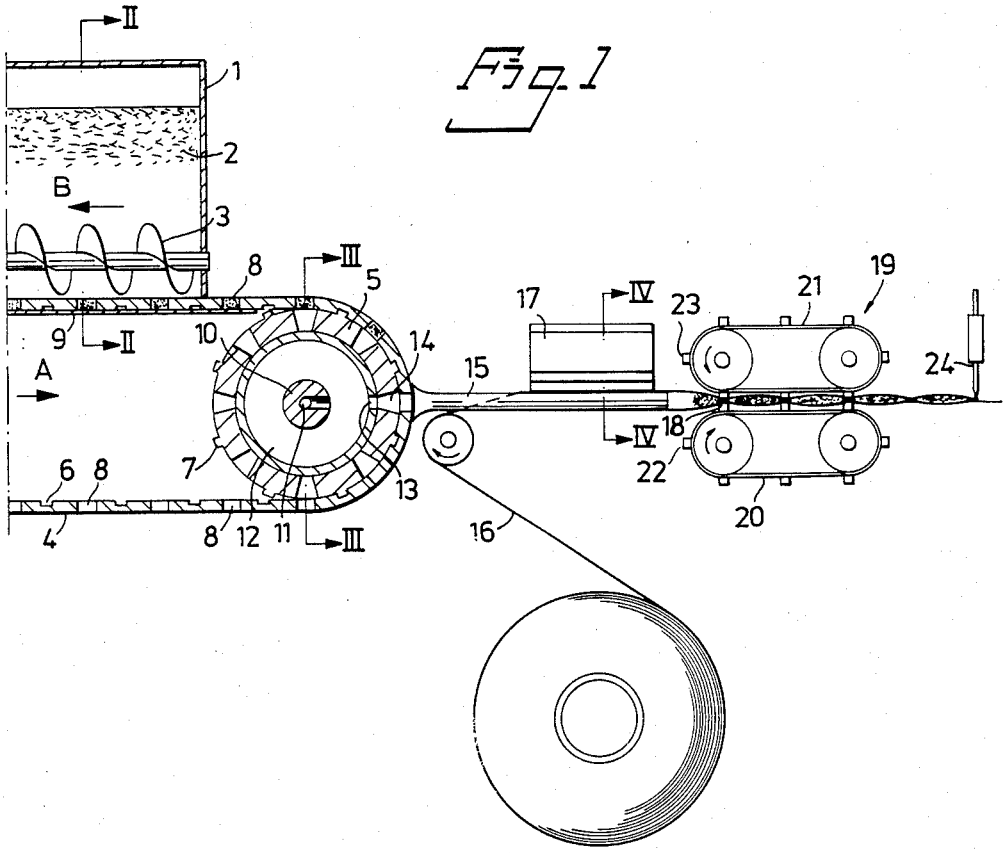
Fig. 1
Fig. 2
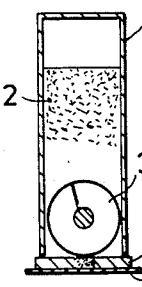
Fig. 3
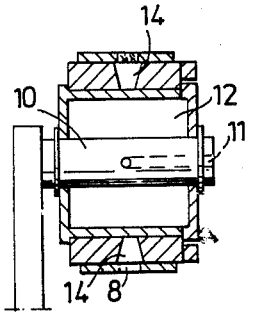
Fig. 4
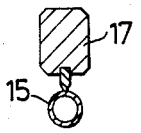

APPARATUS FOR PACKAGING GIVEN QUANTITIES OF SNUFF

The present invention relates to an apparatus for packaging given quantities, or portions, of snuff, comprising a snuff store, metering means for transferring snuff from the store to a snuff-portion conveyor which is provided with portioning pockets and which is arranged to transport the pockets to a discharge station, for sequentially transferring, in turn, filled snuff stations to a movable band.

Because of its consistency, snuff is relatively difficult to package, and in order to enable snuff to pass freely down a storage chute or like device into the portioning pockets, it is normal to work with snuff having a moisture content of less than 30%. Snuff which is ready for consumption should have ideally a moisture content of 50–55%, which means that it must be moistened subsequent to being packeted. The material in which snuff is packaged is of the same kind as that used to package tea, for example. As a result hereof, the total manufacturing process takes a relatively long time to complete, and requires a lot of machinery and a great deal of space.

Consequently, a prime object of the present invention is to provide apparatus of the aforesaid kind with which production can be effected particularly rapidly, by rendering subsequent moistening of the product unnecessary, and by enabling portions of snuff to be pushed onto the packaging band with the aid of pressurized air, without risk of the snuff portions crumbling.

This object is realized by the invention defined in the following claims and described hereinafter with reference to a number of embodiment thereof illustrated in the accompanying drawings, in which FIG. 1 is a simplified illustration of a first preferred embodiment of the invention;

FIG. 2 is a sectional view taken on the line II—II in FIG. 1;

FIG. 3 is a sectional view taken on the line III—III in FIG. 1;

FIG. 4 is a sectional view taken on the line IV—IV in FIG. 1;

Figure 5:
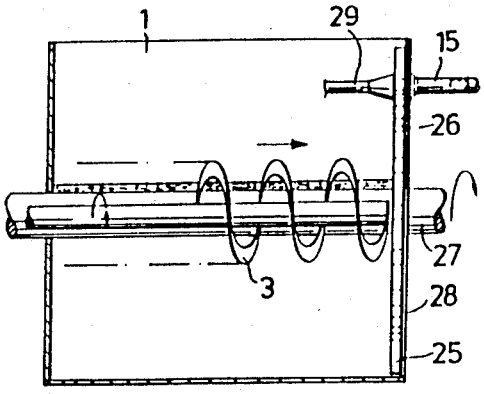
FIG. 5 is a simplified illustration of a second, modified embodiment, seen in plan view.

The apparatus illustrated in FIGS. 1–4 comprises a feed container 1, containing a store of snuff. Arranged in the lower, open end of the container 1 is feed screw 3, which in operation is driven continuously by a motor, not shown. As illustrated in FIG. 2, the feed screw 3 has a diameter corresponding to the distance between the walls of the container 1. An endless portioning belt 4, suitably made of rubber or like material, is arranged beneath the feed container 1, closely adjacent to or in contact with the bottom of the helix of the feed screw 3. The belt 4 extends around a rearward drive roller (not shown) and a forward roller 5, hereinafter referred to as the feed roller. The portioning belt 4 has arranged on the inner surface thereof recesses 6 which co-act with shoulders 7 on the feed roller 5. Thus, the feed roller 5 is driven synchronously with the portioning belt 4. The portioning belt 4 is provided with uniformly spaced, through-passing portion pockets 8, the form of which corresponds to the required portion of snuff. Mounted beneath the upper part of the portioning belt 4, along the opening of the feed container 1, is a glide plate 9, which completely covers the lower open end of the portion pockets 8. The feed roller 5 is freely rotatable about a shaft 10, having provided therein an axially extending channel 11, the outer end of which is connected to a source of air under pressure (not shown) arranged to supply pressurized air constantly to the channel 11. The inner end of the channel 11 opens into a pressure chamber 12 firmly secured to the shaft. Arranged in the wall of the pressure chamber 12 is a blow-out opening 13, and the feed roller is provided with through-passing blow-out nozzles 14, said nozzles being arranged to slide sequentially over the blow-out opening 13 on the stationary pressure chamber 12 and to form a blow-out station. The distance between the blow-out nozzles 14 fully corresponds to the distance between adjacent portion pockets 8.

The portioning belt 4, which is driven in the direction of arrow A, is supplied with snuff by means of the feed screw 3, while sliding against the plate 9, and the feed screw 3 is arranged to feed snuff in the opposite direction to the belt moving direction A, as illustrated by the arrow B in FIG. 1. Thus, snuff is introduced in surplus quantities into each pocket, and since the snuff can be maintained at the moisture content suitable for consumption, there is obtained a compressed snuff portion in which the snuff particles are satisfactorily packed together. As will be understood, the snuff can also be compressed with the aid of a screw 3 arranged to advance snuff in the belt feed direction A, provided the feed rate of the screw exceeds the belt speed. The extent to which the snuff is compacted is essentially determined by the relative differences in speed, and increases with increasing screw speed. Subsequent to the feed roller 5 having been moved to an extent such that a filled pocket 8 and associated blow-nozzles 14 lie in register with the blow-out opening 13, the compressed snuff portion is pushed by the pressurized air into and through a format tube 15. A heat sealable band 16, for example a rayon band containing thermoplastic binder, is fed to the format tube 15, said band being formed in a well known manner into a tube on the outer surface of the format tube 15, and the two mutually overlapping long edges of the band 16 being heat sealed by means of a longitudinal sealing device 17. The newly outwardly displaced snuff portion meets a cross-sealing weld 18 produced by means of a conventional cross-sealing device 19, which in the illustrated embodiment comprises two endless belts 20,21 located on both sides of the paper tube and having pairs of co-acting welding jaws, for example the jaw pair 22, 23. Upon completion of the transverse weld, which results in respective snuff portions lying individually sealed in a continuous band, the snuff portions are separated into individual portions or in band parts, by severing with a knife means 24, for example. Because the measured snuff portion is compressed and very moist, i.e. has a moisture content of about 55%, there is no risk that the portion will "explode" when pushed forcibly into the format tube 15, and neither is there is any risk of snuff particles becoming separated from the compacted snuff and adhering to the inner wall of the paper tube such as to obstruct the transverse weld-sites and prevent reliable welding of the tube.

Figure 6:
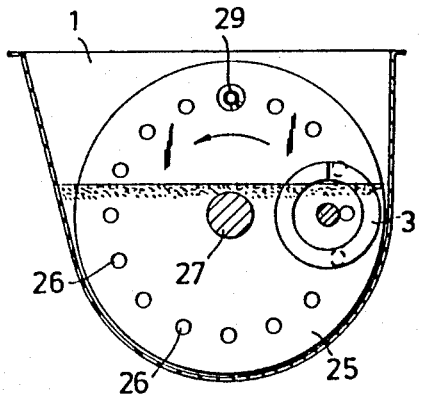
FIG. 6 illustrates the apparatus of FIG. 5, seen from the infeed end of the apparatus.

With regard to function, the modified embodiment illustrated in FIGS. 5 and 6 corresponds to the aforedescribed, preferred embodiment. The main difference between the preferred embodiment and that illustrated in FIGS. 5 and 6 is that the portioning belt 4 is replaced with a circular metal disc 25 which is arranged for rotation about a central axis and which is provided with through-passing portion pockets 26 located around a circular line. The feed screw 3 feeds snuff to the disc 25 mounted on a horizontal shaft 27, the disc within the filling area sliding against a glide plate 28, against which the snuff is compressed in the portion pockets. The portion pockets 26 are moved continuously to a nozzle 29 connected to a pressure source, and the compressed snuff portion is ejected at high speed into the format tube 15.

Figure 7:
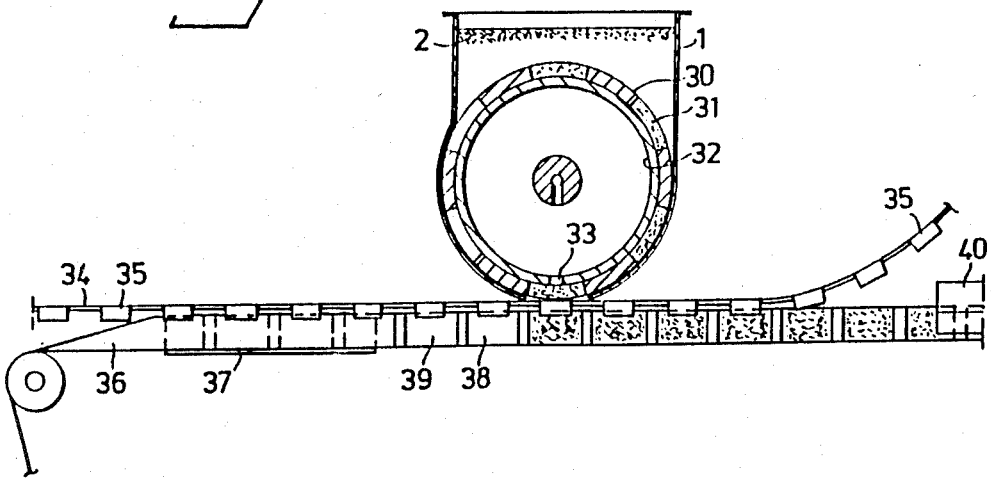
FIG. 7 is a simplified illustration of a third embodiment.

In the embodiment illustrated in FIG. 7, the aforedescribed feed screw 3 has been replaced with a portioning wheel 30 provided with collecting pockets 31. The portioning wheel 30 is mounted in the lower, open end of the feed container 1 and embraces a cylinder 32 forming a pressure chamber. The portioning wheel 30 is slidably arranged on stationary pressure chamber 32, which applies a pressure force as previously described and which is provided with a blow-out opening 33. Each pocket 31 takes up loose snuff from the container 1 as the upper pockets of the wheel move through the mass of snuff located therein. The volume of each pocket 31 is greater than the volume of the desired compressed snuff portion. Co-acting with the lower part of the portioning wheel 30 and the gap in the cylinder 32, is a format belt or a format chain 34, which is provided with portion tubes 35 intended to compress snuff blown from a pocket 31 and to guide the snuff into a V-shaped paper band or strip 36, which is guided up against the format belt 34 by means of a U-shaped former 37, so as to partially embrace the format belt. At a location to the left of the portioning wheel in FIG. 7, the paper band 36 is provided with transverse seals by means of suitable devices herefor (not shown) and snuff is thus blown into upwardly open pockets, for example the pockets 38 and 39. When snuff is blown from a pocket 31, the snuff will be blown into associated tubes successively, as the pocket 31 passes the tube opening and the thoroughly moist snuff will be compressed in the tube, substantially in dependence upon the counter pressure occurring in the tube and as a result of the much shorter extension thereof in the direction of movement of the belt 34. Thus, a compressed snuff portion will be fed into the pocket 39. The snuff, however, is not compressed to the same extent as that in the two previously described embodiments, when short cylindrical tubes 35 are used. The best compacting effects are obtained when downwardly extending conical tubes are used. Thus, despite the fact that the pockets 39 of the belt 36 are open upwardly and the snuff is ejected very rapidly, the possibility of snuff particles bouncing out of the pockets is totally avoided. Subsequent to the pockets 39 being filled, a longitudinal seam is formed by means of a longitudinal sealing apparatus 40, whereafter the portions are separated one from the other.

I claim:

1. Apparatus for packaging snuff portions, comprising a snuff store (2), portioning means (3,9; 3,26) for transferring snuff from said store to a portion conveyor (4; 25) having portion pockets (9; 26) in the form of through-passing openings in the portion conveyor, arranged to transfer the portion pockets to a discharge station for sequentially transferring measured snuff portions by means of pneumatic means (11,14) to a movable packaging band (16), in which each individual snuff portion is enclosed by means of sealing means (17, 20,21), characterized in that the portioning means (3,9; 3,25) are arranged to compress the snuff portion in a respective portion pocket (9; 25); and in that the pneumatic means (11,14) are arranged to exert on the end part of the compressed snuff portion at the discharge station a drive force for blowing the portion to an intended position on the packaging band.

2. Apparatus according to claim 1, characterized by a feed screw (3) mounted in the store and arranged to feed snuff, under pressure, to the portion conveyor (4; 25) and into the portion pockets (9; 26) located thereon.

3. Apparatus according to claim 2, characterized in that the feed screw (3) is arranged to feed snuff at a speed which exceeds the speed of the portion conveyor (4).

4. Apparatus according to claim 1, characterized in that the portioning conveyor (4) comprises an endless flexible belt having open portion pockets (9) evenly spaced therealong, said belt being arranged to extend over a feed roller (5) having arranged therein blow-out nozzles (14) corresponding to the portion pockets (9), and said feed roller (5) being journalled for free rotation on a drum-like pressurized-air chamber (12), having arranged in the wall thereof a blow-out opening (13) over which the nozzles (14) are arranged to move during rotation of the feed roller (5); in that a format tube (15) extends radially towards the feed roller (5) centrally opposite the blow-out opening (13); and in that said formal tube forms firstly a forming means for shaping a tubular package on the outer surface thereof from said packaging band (16), and secondly a guide means for guiding a compressed portion of snuff into said tubular package.

5. Apparatus according to claim 1, characterized in that the portion conveyor (25) has the form of a rigid disc which is driven about its centre axis and which is provided with portion pockets (26) around a circular line; and in that the feed screw (3) is arranged to feed snuff under pressure at right angles to the surface of said disc.

6. Apparatus for packaging moist, flaky materials such as snuff, including a material store (2), a cylindrical wheel (30) having pass-through pockets (31) on the periphery thereof arranged to pick up material from the store (2), a compressed air nozzle arranged to blow the material out of the pass-through pockets one at a time at a discharge location, compacting tubes (35) arranged to receive and compress the material blown out of the pass-through pockets and to guide the compressed material to an intended position on a movable packaging band (36) and sealing means (40) for enclosing each individual material portion.

* * * * *